US005091220A

United States Patent [19]

Horiki et al.

[11] Patent Number: 5,091,220

[45] Date of Patent: Feb. 25, 1992

[54] METHOD OF SURFACE TREATMENT WHEREBY A MASK IS ATTACHED TO THE WORK BY AN ADHESIVE, THE WORK IS SURFACE TREATED, AND THE MASK IS REMOVED BY SUCTION

[75] Inventors: Seinosuke Horiki; Reiji Makino, both of Tokai, Japan

[73] Assignee: Nagoya Oilchemical Co., Ltd., Nagoya, Japan

[21] Appl. No.: 532,017

[22] Filed: Jun. 1, 1990

[30] Foreign Application Priority Data

| | | | |
|---|---|---|---|
| Feb. 6, 1989 | [JP] | Japan | 1-141360 |
| Aug. 11, 1989 | [JP] | Japan | 1-291962 |
| Aug. 22, 1989 | [JP] | Japan | 1-216861 |

[51] Int. Cl.[5] ..... B05D 1/32; B05L 11/00

[52] U.S. Cl. ..... 427/272; 427/282; 427/350; 118/505

[58] Field of Search ..... 427/282, 300, 350, 154, 427/272, 259; 118/505

[56] References Cited

U.S. PATENT DOCUMENTS

| | | | |
|---|---|---|---|
| 2,286,473 | 6/1942 | Duggan | 118/505 |
| 2,290,472 | 3/1942 | Hendrick | 118/505 |
| 2,363,842 | 11/1944 | Duggan | 118/505 |
| 2,672,122 | 3/1954 | Kupec et al. | 118/504 |
| 4,835,026 | 5/1989 | Horiki et al. | 428/40 |
| 4,879,158 | 11/1989 | Horiki et al. | 427/282 |
| 4,913,786 | 4/1990 | Horiki et al. | 427/264 |

*Primary Examiner*—Michael Lusignan
*Assistant Examiner*—Benjamin L. Utech
*Attorney, Agent, or Firm*—Cooper & Dunham

[57] ABSTRACT

A method for shielding areas of an article whereby a masking member is used to protect the selected areas from various surface treatments such as coating, plating, vacuum evaporation, and phosphatizing. The mask is attached to the article with an adhesive, the surface treatment is performed on the article, and the mask is removed by suction. The inventive method is particularly useful on car bodies.

4 Claims, 11 Drawing Sheets

METHOD OF SURFACE TREATMENT WHEREBY A MASK IS ATTACHED TO THE WORK BY AN ADHESIVE, THE WORK IS SURFACE TREATED, AND THE MASK IS REMOVED BY SUCTION

BACKGROUND OF THE INVENTION

The present invention relates to a method for a surface treatment employing masking member(s) to protect part(s) of an article such as a car body from said surface treatment such as coating, plating, vacuum evaporation, phosphatizing, and the like.

More particularly, the present invention relates to a method for a surface treatment comprising attaching masking member(s) on(in) parts of an article which is (are) necessary to protect it from a surface treatment, and removing said masking member(s) by (a) sucker(s).

When a surface treatment is effected on the surface of an article, and if said surface of said article has (a) part(s) on which said surface treatment should not be effected for the reason that another surface treatment is effected on said part(s) after said surface treatment of said surface treatment spoils the appearance of said article and so on, said part(s) of said surface of said article may be covered and protected with said masking member.

In the case of a corrosion, sound, and vibration - proof coating for the underside of a car body, said part(s) may be part(s) on which bracket(s), frame(s), and the like is(are) attached, and hole(s) such as water ejecting hole(s), shaft hole(s), harness hole (s) and the like. If said corrosion, sound, and vibration - proof coating by using a coating agent, such as a polyvinylchloride-sol, a tar-urethane mixture and the like is effected on(in) said part(s) or said hole(s), in a case of said parts on which bracket(s), frame(s), and the like is(are) attached, it is difficult to attach firmly said bracket(s), frame(s), and the like to said part because of the coating layer formed by said coating, and in the case of said hole(s), the surface treatment leaks from said hole(s) to waste said coating agent and further it may be a concern that said coating agent fills in said hole(s) or stains the inside of said hole(s).

In a case where the surface treatment of an article has many parts to be protected from said surface treatment such as said coating of the underside of a car body as above described, many masking members must be attached to(in) said parts (more than 200 parts for one car body) before said surface treatment and accordingly many masking members must also be removed from said parts after said surface treatment.

Further, in a case of a continuous mass-production line, said masking members should be attached to(in) said parts and removed from said parts in a short time.

Still further, in the case of the continuous mass-production line, it is desirable that said masking members are automatically attached to(in) said parts and removed from said parts.

DESCRIPTION OF THE PRIOR ART

Hitherto, a flat type masking member having an adhesive layer on one side has been provided, see U.S. Pat. No. 4,835,026.

Said masking member is used to protect a flat surface part of an article and said masking member is attached to said flat surface part by said adhesive layer thereof. After a surface treatment, said masking member is removed from said flat surface part by a worker's hands or a hook.

Further, a plug type masking member has also been provided, see U.S. Pat. No. 4,913,786.

Said masking member is used to protect a hole in an article and said masking member is inserted into said hole. After a surface treatment, said masking member is removed from said hole by a worker's hands or a hook the same as for said flat type masking member.

Still further, a cap type masking member having a hole is provided, see copending, coassigned U.S. Pat. application Ser. No. 418,264.

This masking member is used to protect a projection of an article and said masking member is put over said projection by inserting said projection into said hole of said masking member.

After a surface treatment, said masking member is removed from said projection by a worker's hands or a hook the same as for said flat type and said plug type masking member.

Nevertheless, as above described, said masking members are removed from said part, said hole, or said projection by hand or hook and much labor and time have been necessary to protect said part, said hole, or said projection. And further, in a case where a hook is employed to remove said masking members, the material into which said hook easily sticks, such as a foamed polystyrene, should be selected as the material of said masking members and it is a concern that the surface or the surface treatment layer around said masking members will be damaged by said hook.

SUMMARY OF THE INVENTION

Accordingly, an object of the present invention is to save labor and time in the case of the removing of said masking members.

Another object of the present invention is to provide a removing method of said masking members suitable for automatic operation.

A further object of the present invention is to provide a method for a surface treatment suitable for a continuous mass-production line.

A still further object of the present invention is to provide a removing method of said masking members applicable for masking members made of any kind of material.

A still further object of the present invention is to provide a removing method in which said masking members can be removed without any damage to the surface or the surface treatment around said masking members.

According to the present invention, there is provided a method for a surface treatment including a removing method of a masking member employing a sucker.

BRIEF DESCRIPTION OF THE DRAWINGS

FIG. 1 is a side sectional view showing that a masking member in a masking tool is attached on a part of an article.

FIG. 2 is a side sectional view showing that said masking member is separated from said masking tool FIG. 3 A,B,C,D, are respectively perspective views of some embodiments of said masking member used in said first embodiment.

FIG. 4 is a partial side sectional view showing the removal of said masking member by a sucker.

FIG. 5 is a partial side sectional view after the removal of said masking member.

FIG. 6 A is a perspective view of another embodiment of said masking member and B is a side sectional view of a further embodiment of said masking member used in said first embodiment.

FIG. 7 is a perspective view of a masking member.

FIG. 8 is a side sectional view showing that a masking member in a masking tool is attached in a hole of an article.

FIG. 9 is a partial side sectional view showing the removal of said masking member by a sucker.

FIG. 10 is a perspective view of another embodiment of said masking member used in said second embodiment FIG. 11 and FIG. 12 relate to a third embodiment of the present invention.

FIG. 14 is a partial side sectional view showing that suckers contact said masking members.

FIG. 15 is a partial side sectional view showing the removal of said masking members by suckers.

FIG. 18 is the same as

FIG. 17.

DETAILED DESCRIPTION

FIG. 1 to FIG. 6 relate to a first embodiment of the present invention. In this invention, a part having a flat surface of an article is protected by a masking member.

Referring now to FIG. 1 to FIG. 6, a flat type masking member(111) has a smooth and flat surface on the upper side(113) and an adhesive layer(114) is formed on the lower side(112) and a plural number of said masking members(111) are placed one upon another to form an accumulation of masking members(117). In said accumulation of masking members(117), said masking members (111) are mutually adhered by said adhesive layer(114) thereof.

A masking tool(120) comprises a cylinder(121) having an inlet(122) at one end and on outlet(123) at the other end, a friction sheet(129) attached to the inside of said cylinder(121), and a piston(124) as a transporting means. Said piston(124) is inserted into said cylinder (121) from said inlet(122) thereof and a handle(126) is connected to the piston rod(124A) of said piston(124) wherein a pin(128) of said piston rod(124A) is inserted in a groove(127A) of a bracket(127)of said handle(126). Said accumulation of masking members(117) is put into said cylinder(121) of said masking tool(120) and said adhesive layer(114) of each masking member(111) faces in a direction to the outlet(123) of said cylinder(121) and said piston(124) of said masking tool(120) contacts with the upper side(113) of one of said masking members (111) which is located in the uppermost position of said accumulation of masking members(117).

Figure 1:
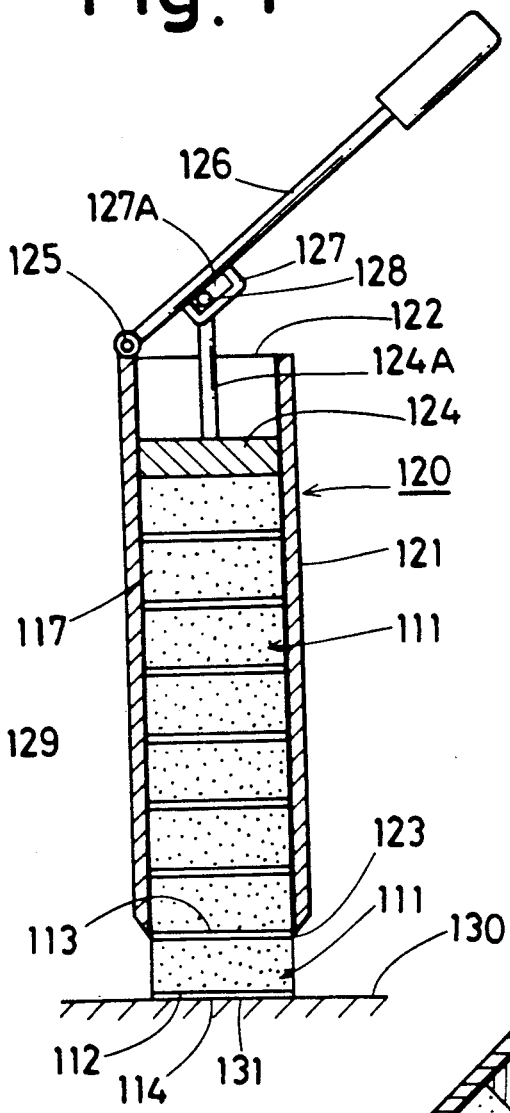
FIG. 1 to FIG. 6 relate to a first embodiment of the present invention.
Figure 2:
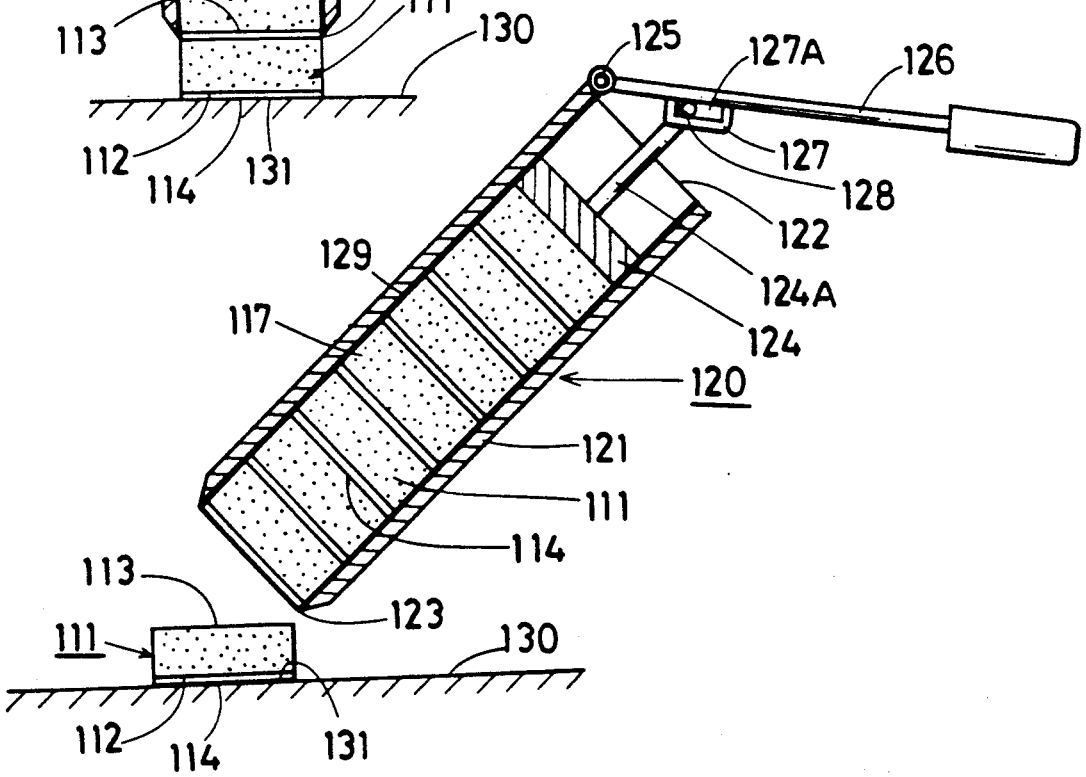

Said masking members(111) of said accumulation(117) are successively transported from the inlet(122) to the outlet(123) in said cylinder(121) by operation of said piston(124) by said handle(126). Said handle may be operated by hand, oil pressure, electromagnetic means, and the like. Thus, one of said masking members(111) located in the lowest position of said accumulation(117) is pushed out from the outlet(123) of said cylinder(121) by operation of said piston(124) and attached to a part (131) having a flat surface of an article(130) by said adhesive layer(114) of said masking member(111) as shown in FIG. 1. After then, said masking member(111) is separated from said accumulation(117) in said cylinder(121) of said masking tool(120) as shown in FIG. 2.

If desired, said masking tool(120) is operated by a robot and in this case, said masking members(111) are automatically attached to said part(131) without the necessity of a worker's hands. Further, said piston (124) may be directly operated by a pressure oil cylinder, an electromagnetic cylinder, and the like instead of said handle(126).

Said masking member(111) is made of a material, such as a plastic or a rubber such as polystyrene, polyethylene, polypropylene, ethylene-propylene copolymer, polyvinylchloride, polyvinylidene chloride, polymethacrylate, styrene-butadiene copolymer, acrylonitrile-butadiene copolymer, polybutadine polyisoprene, polyisobutylene, polychloroprene, isoprene-isobutylene copolymer, natural rubber, polyurethane, melamine resin, urea resin, phenol resin, epoxy resin and the like; foams of said plastic or said rubber; a mixture of said plastic or said rubber with a filler such as calcium carbonate, talc, bentonite, fly ash, blast furnace slag, and the like; a fiber material such as thermoplastic resin -impregnated fiber; a thermosetting resin- impregnated fiber, wooden material such as wood, hardboard, plywood and the like; metal material and the like; composite material consisting of a plural number of materials selected from the group of said materials.

Desirably, a material having small gas permeability should be selected as the material of said masking member (111) and the upper side of said masking member(111) should have a smooth flat part.

Nevertheless, in the present invention, a material having a large gas permeability such as foams of plastic or rubber, a fiber material are also usable as a material of said masking member(111) if a material having a small gas permeability such as a plastic film, a metal film is laminated on said material.

In said accumulation of masking members(117), it is desirable that the peeling strength between said masking member(111) and said part(131) of said article (130) be adjusted larger than the peeling strength between a pair of said masking members(111), (111) mutually in contact.

To satisfy the above described conditions, the contact area between said masking member(111) and said part(131) should be adjusted larger than the contact area between a pair of said masking members(111),(111) mutually in contact, or the bonding strength between said masking member(111) and said part(131) should be adjusted larger than the bonding strength between a pair of said masking members(111),(111) mutually in contact.

Figure 3A:
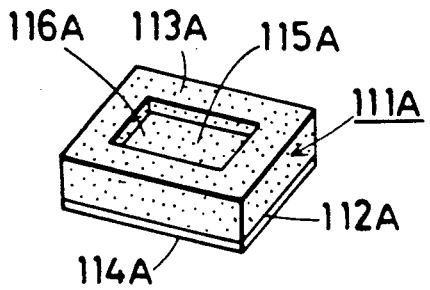
Figure 3B:
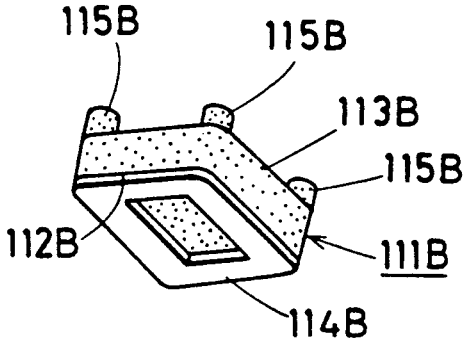
Figure 3C:
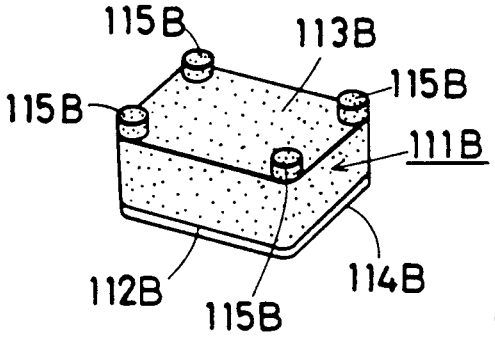
Figure 3D:
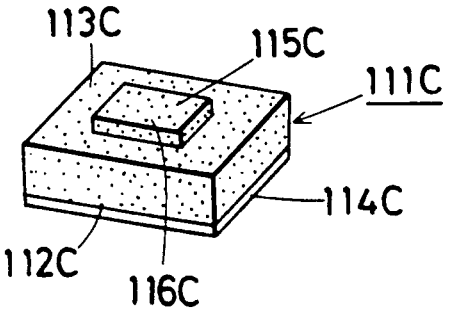

In a case where the contact area between said masking member(111) and said part(131) is adjusted larger than the contact area between a pair of said masking members(111),(111) mutually in contact, said adhesive layer(114A) is fully formed on the lower side(112A) of said masking member(111A) and a dent(115A) having a smooth and flat surface(116A) in the bottom thereof is formed on the upper side(113A) of said masking member (111A) as shown in FIG. 3 A, or said adhesive layer(114B) is partially formed on the circumference of the lower side(112B) of said masking member(111B) and a smooth and flat surface is fully formed on the upper side(113B) wherein four projections(115B) are respectively formed on the four corners of said upper side(113B) as shown in FIG. 3B and FIG. 3C, or said adhesive layer(114C) is fully formed on the lower side(112C) of said masking member(111C) and a projection(115C) having a smooth and flat surface(116C) is formed on the upper side(113C) of said masking member(111C) as shown in

FIG. 4C.

Figure 4:
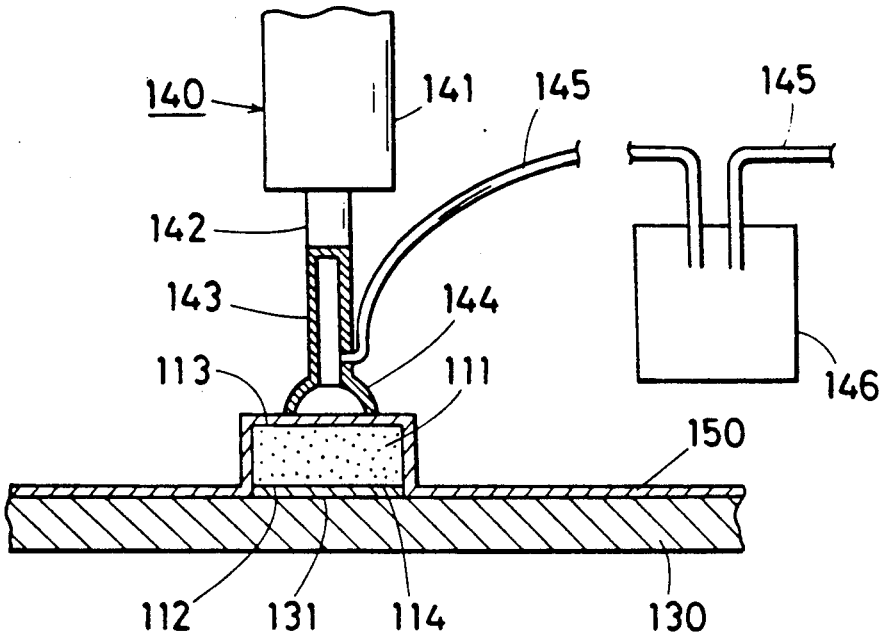

As above described, said masking member(111) is attached to said part(131) of said article(130) by said adhesive layer(114) formed on the lower side(112) of said masking member(111), and after this, a paint such as a polyvinylchloride-sol, a urethane resin, an asphalt, a rubber-asphalt mixture, a tar-urethane mixture and the like is coated on the surface of said article to form a coating layer(150) as shown in FIG. 4. After said coating, said masking member(111) is removed from said part(131).

Figure 5:
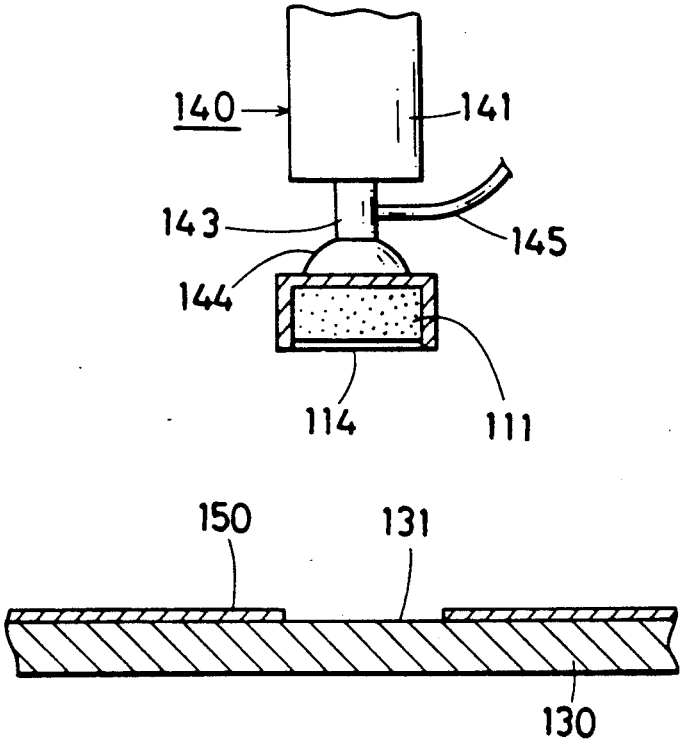

To remove said masking member(111) from said part (131), a removing tool(140) as shown in FIG. 4 is used. Said removing tool(140) comprises an oil pressure cylinder(141), a pipe(143) attached at the end of the piston rod(142) of said oil pressure cylinder(141), a sucker (144) attached at the end of said pipe(143), and a vacuum tube(145) in which a trap(146) intermediates. Said sucker(144) is made of a rubber, a plastic, a metal, and the like. Said sucker(144) of said removing tool (140) contacts with the upper side(113) of said masking member(111) and said masking member(111) is sucked up by said sucker(144). Said coating layer(150) is sucked into said vacuum tube(145) through said sucker(144) and said pipe(143) and collected in said trap(146). After this, said piston rod(142) is lifted by the operation of said oil pressure cylinder(141) to peel said masking member(111) from said part(131) of said article (130) as shown in FIG. 5. Said masking member(111) may be removed from said sucker(144) of said removing tool (140) by opening said vacuum tube(145) to the atmosphere or by putting air into said vacuum tube(145).

Figure 6A:
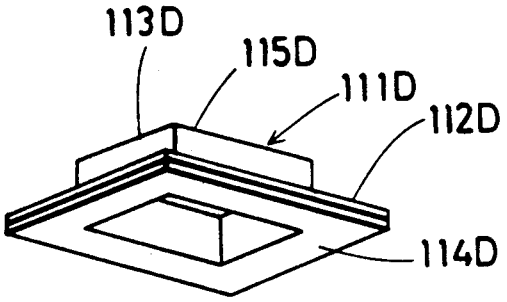
Figure 6B:
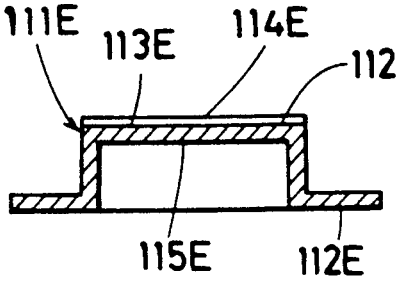

FIG. 6A and FIG. 6B show other embodiments of said masking member(111) used to protect a part having a flat surface of an article in the first embodiment.

Referring now to

FIG. 6 A, a vessel type masking member(111D) has a flange(112D) at the open end and an adhesive layer(114D) is formed on said flange(112D). Further said masking member(111D) has a smooth and flat surface(115D) on the outside of the bottom(113D).

Said masking member(111) is attached to said part (131) having a flat surface of said article by said adhesive layer(114) the same as for said masking member (111) shown in FIG. 3 A,B,C,D and peeled from said part (131) by said removing tool(140) by sucking said surface (115D) of the outside of the bottom(113D) of said masking member(111D).

Referring now to

FIG. 6 B, a vessel type masking member(111E) has a flange(112E) at the open end and an adhesive layer(114E) is formed on the outside of the bottom(113E) wherein a smooth and flat surface(115E) is formed on the inside of the bottom(113E). Said masking member(111E) is attached to said part(131) of said article by said adhesive layer(114) the same as for said masking member(111) shown in FIG. 3 A,B,C,D and FIG. 6A and peeled from said part(131) by said removing tool(140) by sucking said surface(115E) at the inside of the bottom(113E) of said masking member(111E).

Figure 7:
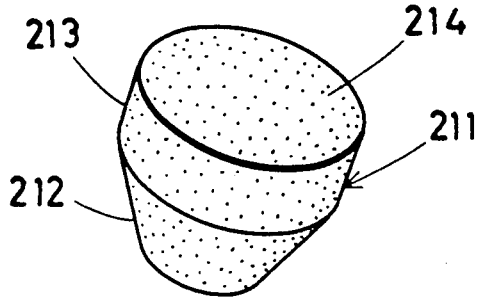
FIG. 7 to FIG. 10 relate to a second embodiment of the present invention.
Figure 8:
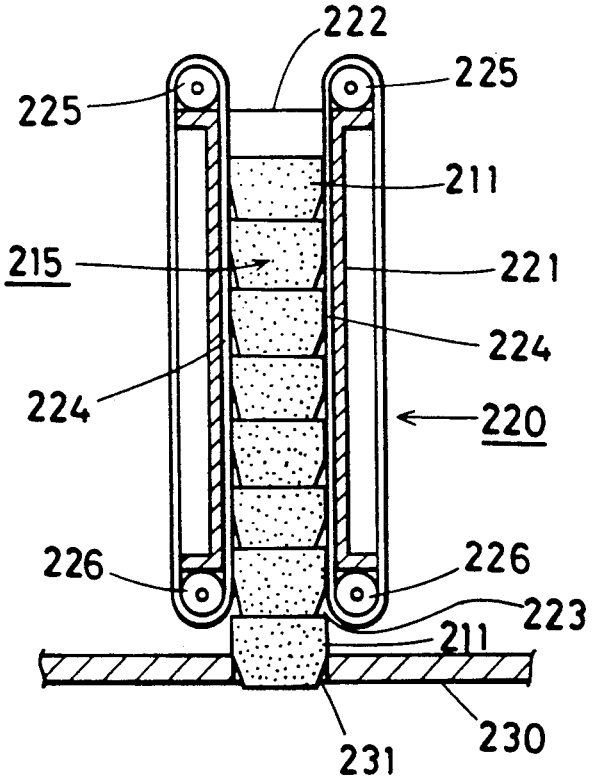
Figure 9:
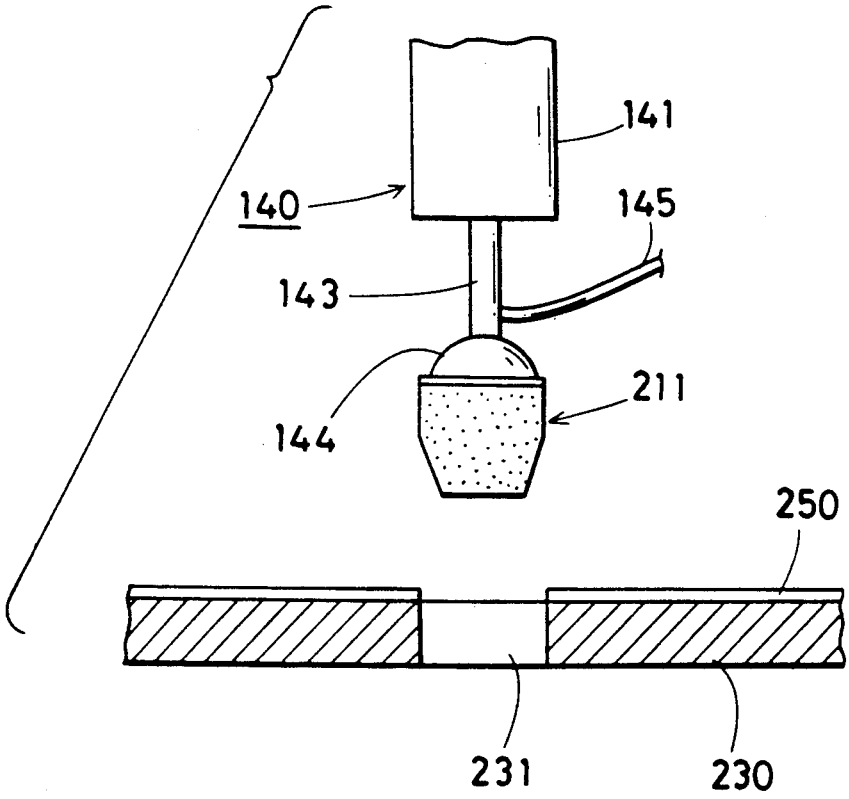

FIG. 7 to FIG. 9 relate to a second embodiment of the present invention. In this invention, a hole in an article is protected by a masking member.

Referring now to FIG. 7 to FIG. 9, a plug type masking member(211) consists of a tapered part(212) and cylinderical part(213) and the upper side of said cylinderical part(213) forms a smooth and flat surface(214).

A masking tool(220) of this embodiment comprises a cylinder(221) having an inlet(222) at one end and an outlet(223) at the other end, and a pair of endless belts(224),(224) acting as a transporting means. Each of said endless belts(224),(224) is suspended on a pair of rollers(225),(226) wherein one set of said rollers (225), is rotatably attached to the inlet(222) of said cylinder(221) and the other set of said rollers(226) are rotatably attached to the outlet(223) of said cylinder(221). Said endless belts(224),(224) are respectively made of a friction material such as a rubber, a cloth having a flocking layer, and the like.

A plural number of said masking members(221) are placed one upon another to form an accumulation of masking members(215) and said accumulation of masking members(215) is put into said cylinder(221) of said masking tool(220) wherein said accumulation of masking members(215) is trapped between a pair of said endless belts(224),(224) in said cylinder(221) of said masking tool(220).

Said masking member(221) of said accumulation(215) are successively transported from the inlet(222) to the outlet(223) in said cylinder(221) by driving said rollers(225),(226) by a driving means such as a motor and the like to insert said masking members(211) into a hole(231) in an article(230) as shown in FIG. 8. After a surface treatment layer(250) is formed on the surface of said article(230), said masking member(221) is removed from said hole(231) by using said removing tool(140) of the first embodiment by sucking said surface(214) of said masking member(211).

Figure 10:
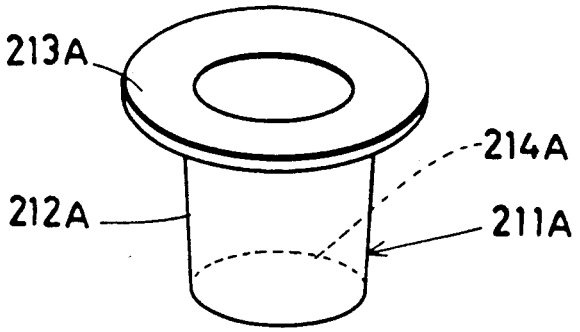

FIG. 10 shows another embodiment of said masking member used to protect a hole in an article.

Referring now to

FIG. 10, a masking member(211A) consists of a vessel type inserting part(212A) and a flange(213A) wherein a smooth and flat surface(214A) is formed on the inside of the bottom of said inserting part(212A). Said masking member(211A) is attached in said hole(231) of said article(230) by inserting said inserting part(212A) thereof and removing it from said hole(231) by said removing tool(140) by sucking said surface(214A) of said masking member(211).

FIG. 11 and

Figure 12:
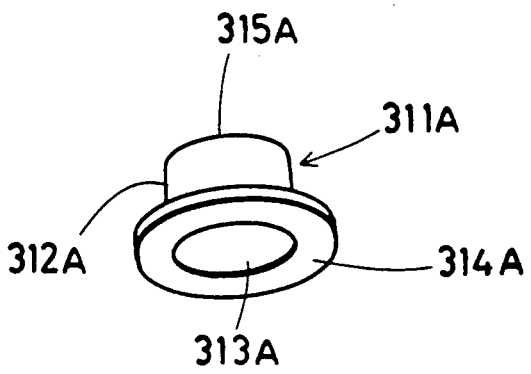
FIG. 12 is a perspective view of another type of said masking member used in said third embodiment.

FIG. 12 relate to a third embodiment of the present invention. In this embodiment, a projection of an article is protected by a masking member.

Figure 11:
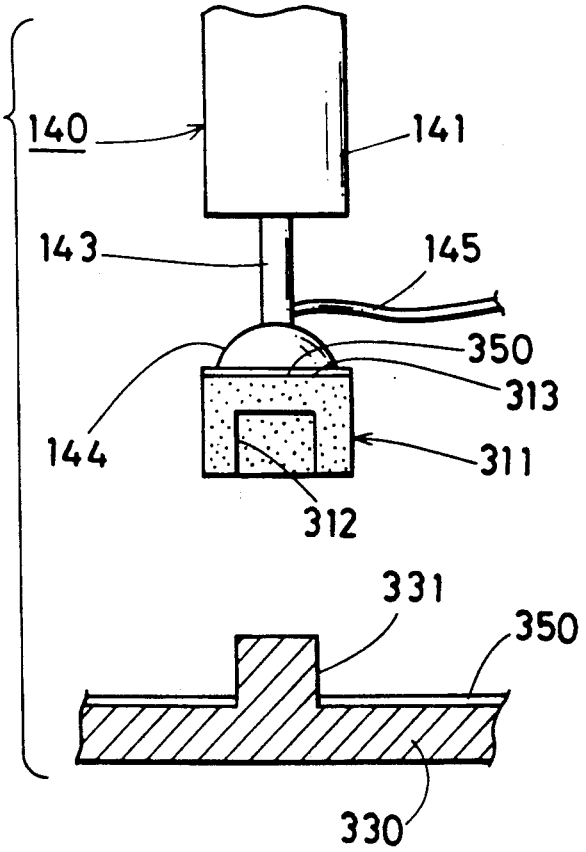
FIG. 11 is a partial side sectional view showing the removal of a masking member by a sucker.

Referring now to FIG. 11 and FIG. 12, a cap type masking member(311) having a hole(312) and a smooth and flat surface(313) on the upper side thereof is attached over a projection(331) of an article(330) by inserting said projection(331) into said hole(312) of said masking member(311) and removing it from said projection(331) by said removing tool(140) by sucking said surface(313) of said masking member(311) after a surface treatment layer(350) is formed on said article(330).

FIG. 12 shows another embodiment of said masking member used to protect a hole in an article and said masking member(311A) consists of a vessel type cap part (312A) having a hole(313A) and a flange(314A) wherein a smooth and flat surface(315A) is formed on the outside of the bottom of said cap part(312A). Said masking member(311A) is attached over said projection(331) of said article(330) by inserting said projection into said hole(313A) of said cap part(312A) thereof and is removed from said projection(331) by said removing tool (140) by sucking said surface(315A) of said masking member(311A).

Figure 13:
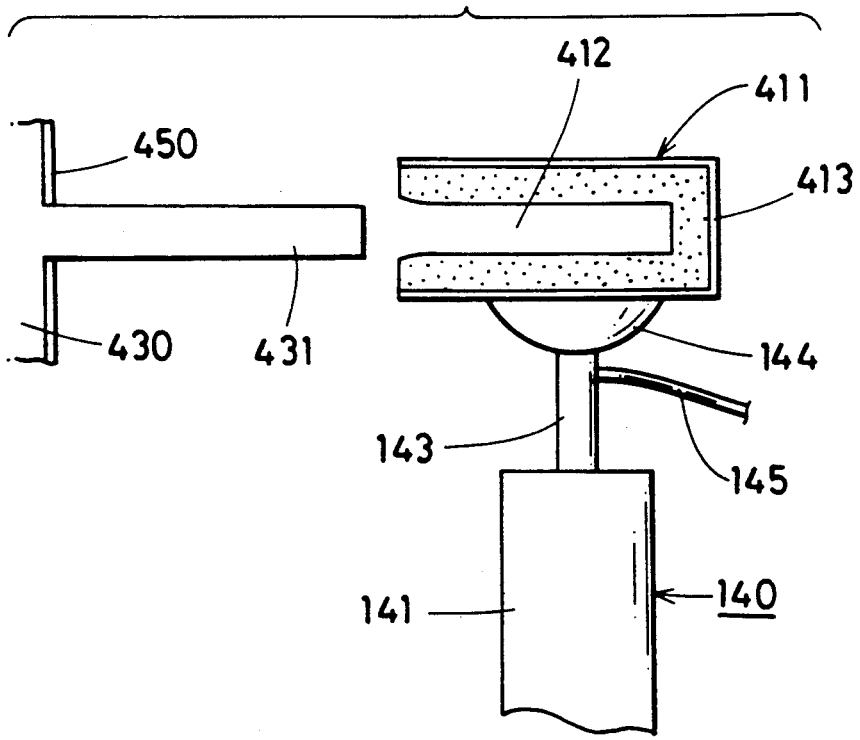
FIG. 13 relates to a fourth embodiment of the present invention and is a side view showing the removal of a masking member.

FIG. 13 relates to a fourth embodiment. In this embodiment, a flat part(431) of an article(430) is protected by a clip type masking member(411) having a slit(412) wherein a smooth and flat surface(413) is formed on the outside of said masking member(411). Said masking member(411) is attached onto said flat part(431) of said article(430) by inserting said flat part(431) of said article(430) and is removed from said flat part(431) by said removing tool(140) by sucking said surface(413) of said masking member(411).

FIG. 14 and

Figure 15:
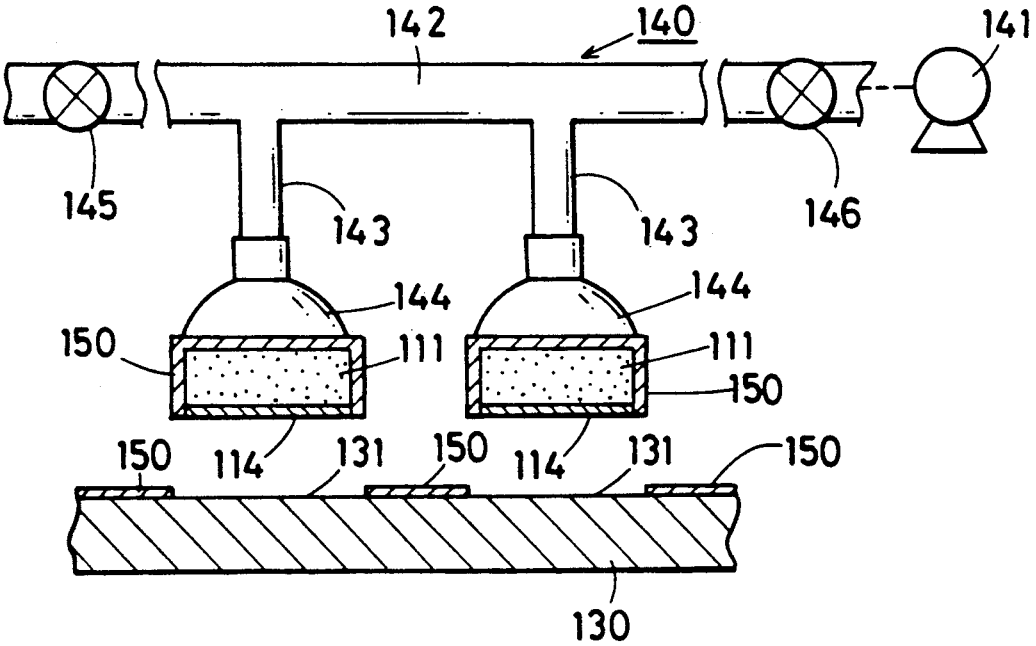

FIG. 15 relate to a fifth embodiment. In this embodiment, a plural number of said masking members(111) of the first embodiment are removed by a removing tool(240).

Figure 14:
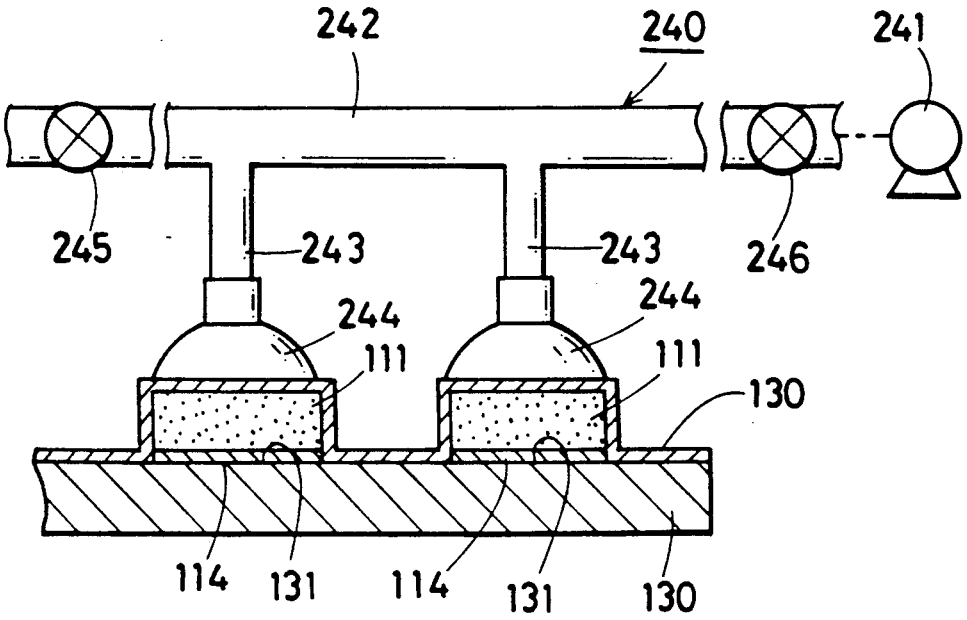
FIG. 14 and FIG. 15 relate to a fifth embodiment of the present invention.

Referring now to FIG. 14 and FIG. 15, said removing tool(240) comprises a vacuum pipe(242) connected to a vacuum pump(241), a plural number of branch pipes(243) connected to said vacuum pipe(242), a plural number of suckers(244) connected respectively to the lower end of said branch pipes(243), and a pair of valves(245), (246) arranged at both ends of said vacuum pipe(242).

To remove a plural number of said masking members (111) from said plural numbers of said parts(131) of said article(130) on which a surface treatment layer(150) is formed, a plural number of said masking members(111) are respectively sucked up by a plural number of said suckers(244) of said removing tool(240) as shown in FIG. 14 and said removing tool(240) is lifted to peel a plural number of said masking members(111) from a plural number of said part(131) at one time as shown in FIG. 15. To suck a plural number of said masking members(111) as above described, said valve(145) is shut and said valve(146) is opened and said vacuum pump (141) is operated. To separate a plural number of said masking members(111) from said removing tool(240), said valve(145) is opened. If desired, said valve(146) is shut and/or said vacuum pump(141) is stopped. Further, to suck a plural number of said masking members(111), a pair of said valves(145),(146) are opened and said vacuum pump(141) is operated, thus air passes through said vacuum pipe(142) and a plural number of said masking member(111) are also sucked up by a plural number of said suckers(144).

Figure 16:
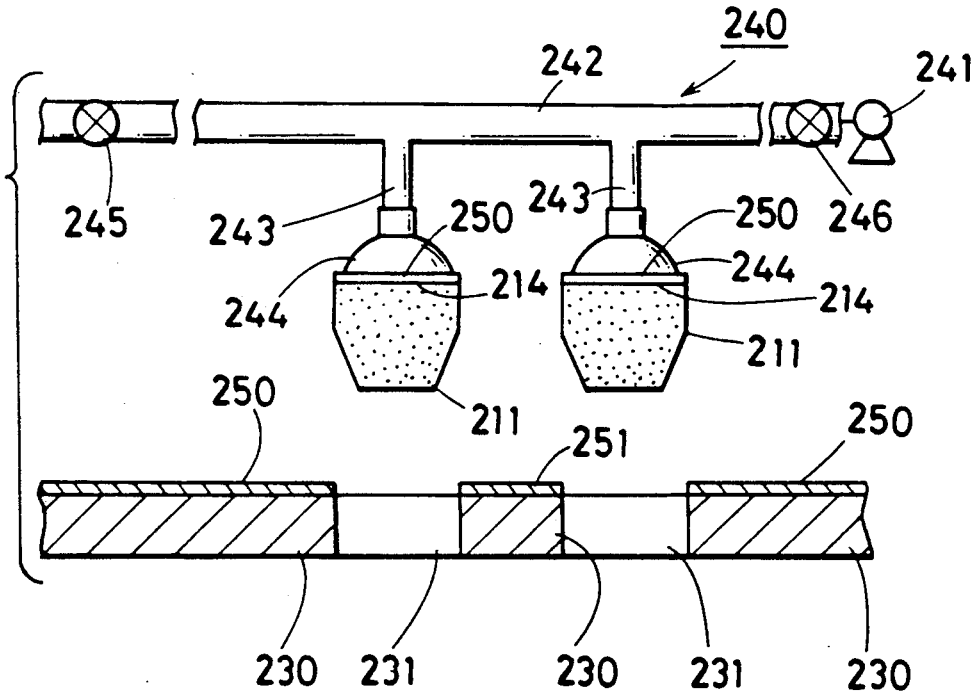
FIG. 16 relates to a sixth embodiment of the present invention and is a partial side sectional view showing the removal of said masking members by suckers.

FIG. 16 relates to a sixth embodiment. In this embodiment, a plural number of said masking members(211) of the second embodiment are removed at one time from a plural number of said holes(231) of said article(230), on which a surface treatment layer(250) is formed, by said removing tool(240).

Figure 17:
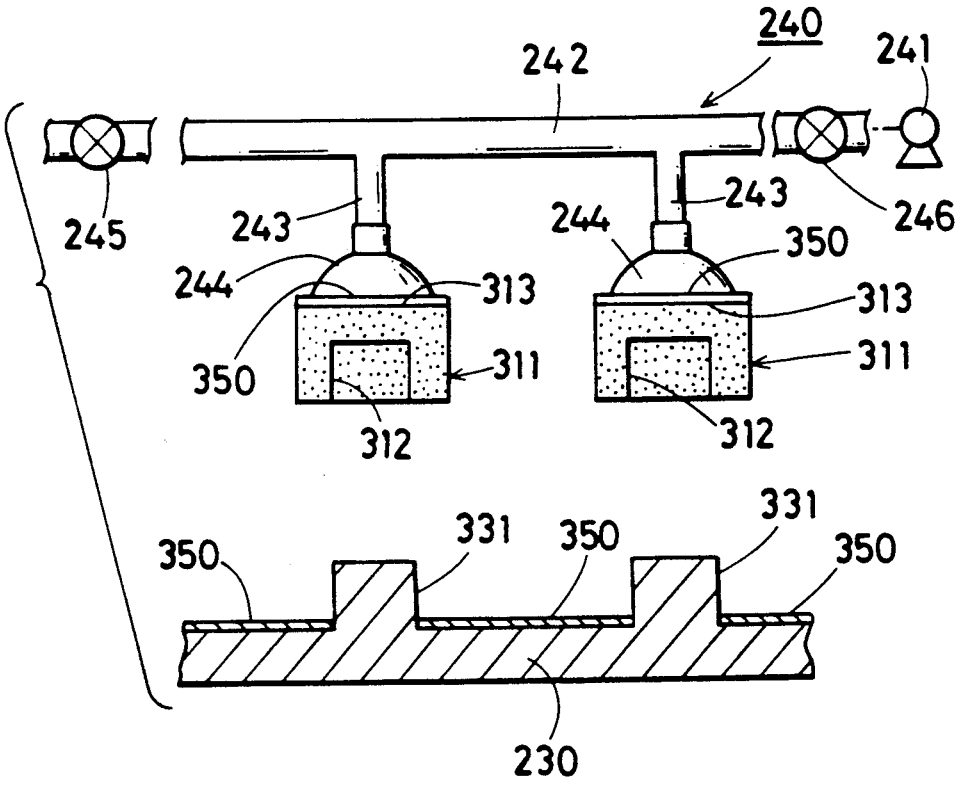
FIG. 17 relates to a seventh embodiment of the present invention and is a perspective view showing the removal of masking members.

FIG. 17 relates to a seventh embodiment. In this embodiment, a plural number of said masking members(311) of the third embodiment are removed at one time from a plural number of said projection(331) of said article (330), on which a surface treatment layer(350) is formed, by said removing tool(240).

Figure 18:
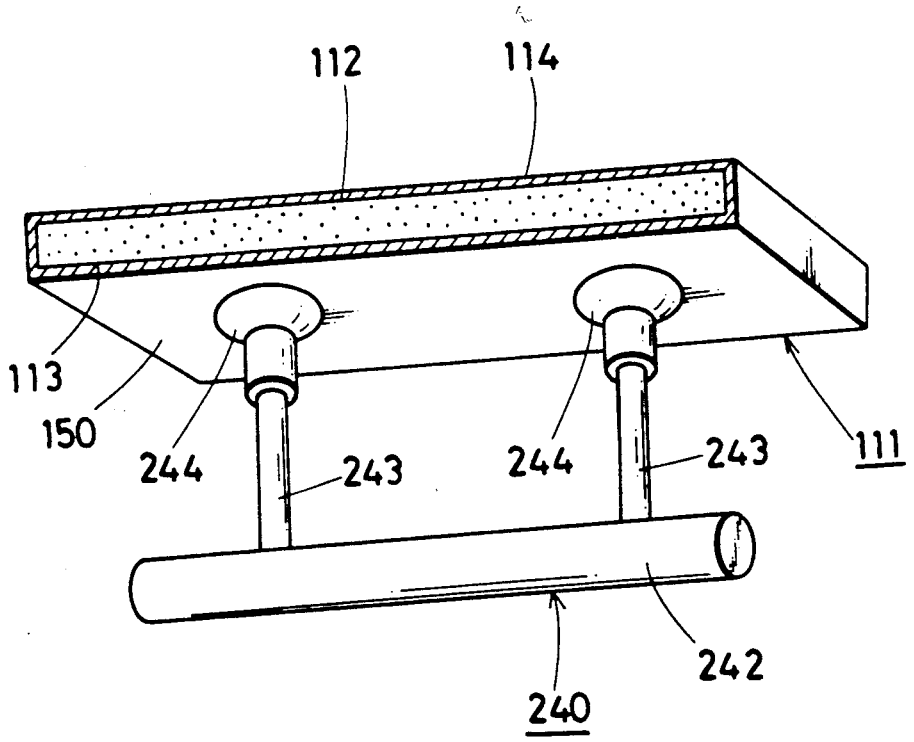

FIG. 18 relates to an eighth embodiment. In this embodiment, said masking member(111) having a large capacity is removed by a pair of said suckers(244) of said removing tool(240) from a part of an article.

We claim:

1. A method of surface treatment employing a masking member to protect a part of an article from said surface treatment which comprises attaching said masking member by adhesive onto said part of said article to protect said part from said surface treatment, effecting said surface treatment of said article and removing by suction said masking member from said part of said article.

2. A method for a surface treatment in accordance with claim 1, wherein said masking member is flat and said part to be protected by said masking member is a flat surface.

3. A method for surface treatment in accordance with claim 1, wherein said masking member is a plug and said part to be protected by said masking member is a hole.

4. A method for a surface treatment in accordance with claim 1, wherein said masking member is a cap and said part to be protected by said masking member is a projection.

* * * * *